US006776588B1

(12) United States Patent
Arndt et al.

(10) Patent No.: US 6,776,588 B1
(45) Date of Patent: Aug. 17, 2004

(54) DRY COMPRESSING VACUUM PUMP HAVING A GAS BALLAST DEVICE

(75) Inventors: Lutz Arndt, Troisdorf (DE); Thomas Dreifert, Köln (DE); Michael Hölzemer, Bergheim (DE); Jürgen Meyer, Pulheim (DE); Frank Schönborn, Köln (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/168,289

(22) PCT Filed: Aug. 23, 2000

(86) PCT No.: PCT/EP00/08201

§ 371 (c)(1),
(2), (4) Date: Jun. 17, 2002

(87) PCT Pub. No.: WO01/46592

PCT Pub. Date: Jun. 28, 2001

(30) Foreign Application Priority Data

Dec. 22, 1999 (DE) ..... 199 62 445

(51) Int. Cl.[7] ..... F04B 25/00
(52) U.S. Cl. ..... 417/250; 418/15
(58) Field of Search ..... 417/250, 267, 417/440; 418/15

(56) References Cited

U.S. PATENT DOCUMENTS

| | | | | |
|---|---|---|---|---|
| 3,116,872 A | * | 1/1964 | Buechel et al. | 417/250 |
| 3,470,706 A | * | 10/1969 | Mitchell et al. | 417/250 |
| 3,677,664 A | | 7/1972 | Wycliffe et al. | |
| 4,236,876 A | * | 12/1980 | Fraser et al. | 417/250 |
| 5,066,202 A | | 11/1991 | Berges et al. | |
| 5,209,653 A | | 5/1993 | Murray et al. | |
| 5,573,387 A | | 11/1996 | Holbrook | |
| 6,123,516 A | | 9/2000 | Burghard et al. | |

FOREIGN PATENT DOCUMENTS

| | | |
|---|---|---|
| DE | 19709206 | 10/1998 |
| GB | 1364854 | 8/1974 |
| JP | 07-006962 | 10/1995 |
| WO | WO 98/09077 | 3/1998 |

* cited by examiner

*Primary Examiner*—Michael Koczo
(74) *Attorney, Agent, or Firm*—Fay, Sharpe, Fagan, Minnich & McKee, LLP

(57) ABSTRACT

A dry compressing vacuum pump (1) has a continuous or graduated inner compression. A gas ballast device (8) selectively adds a ballast gas to a pumped gas. The gas ballast device has an isolating valve (11), a non-return valve (12) which prevents the escape of gases from the pump through the gas ballast device to the outside, and a pressure differential valve (13).

8 Claims, 2 Drawing Sheets

DRY COMPRESSING VACUUM PUMP HAVING A GAS BALLAST DEVICE

BACKGROUND OF THE INVENTION

The present invention relates to a dry compressing vacuum pump having a continuous or graduated inner compression and comprising a gas ballast device.

The term "dry compressing vacuum pump with inner compression" denotes any vacuum pump, the pump chamber or pump chambers of which is/are free of oil and where the volume of the pump chamber decreases in a continuous or graduated manner from the inlet to the outlet of the pump. An example for a dry compressing vacuum pump having a continuously decreasing pump chamber volume is a screw vacuum pump with threads, the pitch, depth and/or width of which decrease continuously from the inlet to the outlet. Examples for dry compressing vacuum pumps where the inner compression decreases in a graduated manner are multi-stage claws, Roots or piston vacuum pumps in which the volume of the pump or compression chambers decreases from stage to stage. Also in the instance of screw vacuum pumps it is known to design the threads such that these change their properties in a graduated manner.

Dry compressing vacuum pumps are generally employed in applications (semiconductor production, for example) in which toxic, very expensive or also explosive gases need to be pumped.

It is known to employ in the instance of dry compressing vacuum pumps of the kind mentioned, gas ballast devices for the purpose of avoiding condensation in the area on the outlet side. The gas ballast is therefore supplied into the pump chambers or pump chamber sections at the outlet area.

Dry compressing vacuum pumps of the kind affected here exhibit, owing to their inner compression in the area of their outlet, pressures which not only exceed the inlet pressure but which can also significantly exceed atmospheric pressure. This also applies to the instance in which bypass valves are employed, since these valves throttle a large gas flow owing to their limited cross sections. Would a vacuum pump of the kind affected here be operated during this operational phase with an open gas ballast valve, then gases pumped by the pump would enter from the pump chamber into the atmosphere.

It is the task of the present invention to design the gas ballast device for a vacuum pump of the kind mentioned above in such a manner that the risk of gases escaping no longer exists. Moreover, it shall be achieved that gas ballast operation will not impose an additional load on the pump's drive motor.

SUMMARY OF THE INVENTION

This task is solved through the characterising features of the patent claims. In that a component of the gas ballast device is a non-return valve, it can be ensured that gases pumped by the pump can not escape to the outside through the gas ballast device.

It is expedient to provide, in addition, a differential pressure valve which allows the admittance of the ballast gas only starting at a certain pressure difference. Through this measure it can be ensured that the admission of the gas ballast into the vacuum pump will only be possible at a pressure below that defined through the differential pressure valve. Unnecessary loading of the pump by the admitted ballast gases can thus be avoided.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
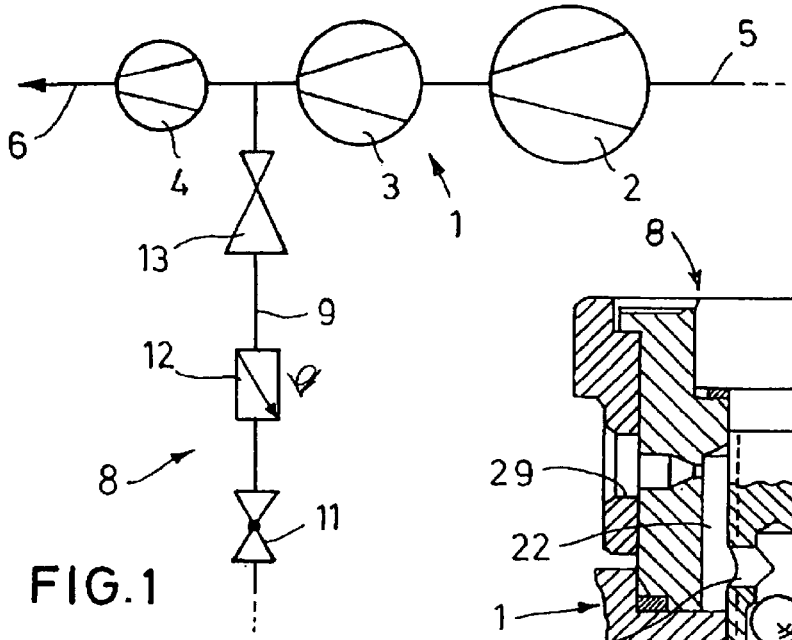
FIG. 1 is a schematic representation of a multi-stage pump equipped with a gas ballast device in accordance with the present invention.

The pump 1 according to FIG. 1 comprises three stages 2, 3, 4 where the pump chamber volume decreases from the inlet 5 to the outlet 6. Connected between the last but one and the last stage is a gas ballast device 8 designed in accordance with the present invention which in a gas ballast feed line 9 has—arranged in any sequence—an isolating valve 11, a non-return valve 12 and a differential pressure valve 13.

With the aid of the isolating valve 11, the gas ballast mode may be switched on and off in a known manner. The non-return valve 12 is so built-in that it prevents gases being pumped by the pump 1 from escaping through the line 9. The differential pressure valve 13 has the effect that with valve 11 open, the ballast gas can only enter into the pump 1 when the pressure in the area of the gas ballast inlet drops below a pressure defined by the differential pressure valve.

Figure 2:
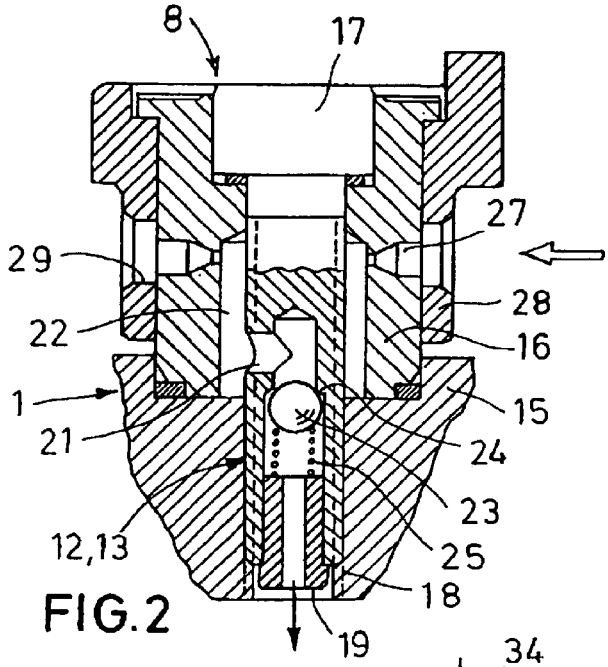
FIG. 2 illustrates a specific embodiment of the gas ballast device.

Depicted in FIG. 2 is an embodiment for the gas ballast device 8 which is affixed directly to the casing 15 of a vacuum pump 1. Said gas ballast device comprises the casing 16, which is affixed to the vacuum pump 1 with the aid of a bolt 17. Bolt 17 is screwed into the channel 18 serving the purpose of feeding the ballast gas in, and said screw has in this area a hollow shank 19 which is linked via a lateral opening 21 to the inside chamber 22 of the casing 16. Located in the hollow chamber 19 is the non-return valve 12. It consists of a ball 23 (made of an elastomer material, for example), a seat 24 (made of steel, for example) and a spring 25 working in the direction of the closed position.

The inside chamber 22 of the cylindrically designed casing 16 has lateral openings 27. A rotatable sleeve 28 encompassing the casing 16 has, in the position shown, concentric cut-outs 29 with respect to the openings 27. The gas ballast feed is opened and closed by turning the sleeve 28.

Figure 3:
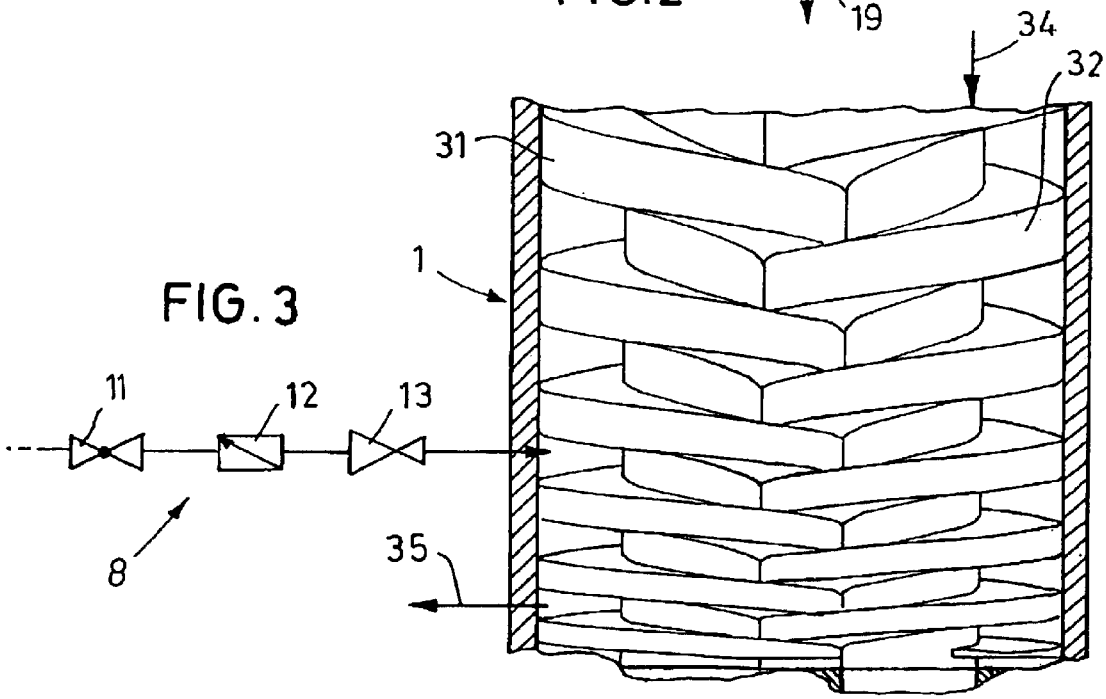
FIG. 3 illustrates the rotors of a screw vacuum pump with inner compression.

Depicted in FIG. 3 are the rotors 31, 32 of a dry compressing vacuum pump 1 operating in accordance with the screw principle. Inlet and outlet are depicted schematically through arrows 34, 35. The threads of the rotors 31, 32 decrease in pitch, and the land of the threads also decreases. In the vicinity of the outlet there is provided a gas ballast feed through the gas ballast device 8.

Screw vacuum pumps are expediently operated with a significant amount of inner compression so that a maximum power uptake of the drive motor is attained at an inlet pressure of approximately 300 mbar. At this inlet pressure no ballast gas needs to be fed in, since the then commonly high temperatures of the pump prevent any condensation. If in this operating mode ballast gas were to be pumped, this would result in an additional uptake of power, i.e. additional motor power would have to be available. For this reason it is expedient to rate the differential pressure valve 13 so that the gas ballast supply can only be effected at a relatively great pressure difference. If, for example, the opening pressure of the differential pressure valve amounts to 900 mbar, the gas ballast could then only be admitted at a pressure of about 100 mbar (atmospheric pressure minus 900 mbar). In this operating mode, full motor power is no longer required so that no higher motor power needs to be installed for the gas ballast.

Figure 4:
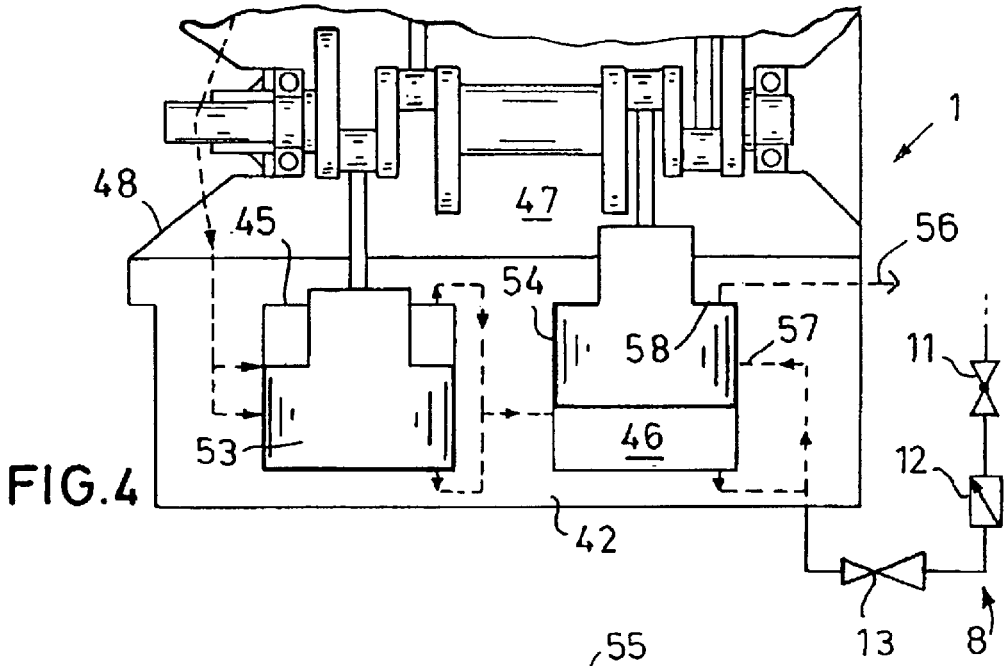
FIGS. 4 and 5 illustrate examples of multistage piston vacuum pumps.
Figure 5:
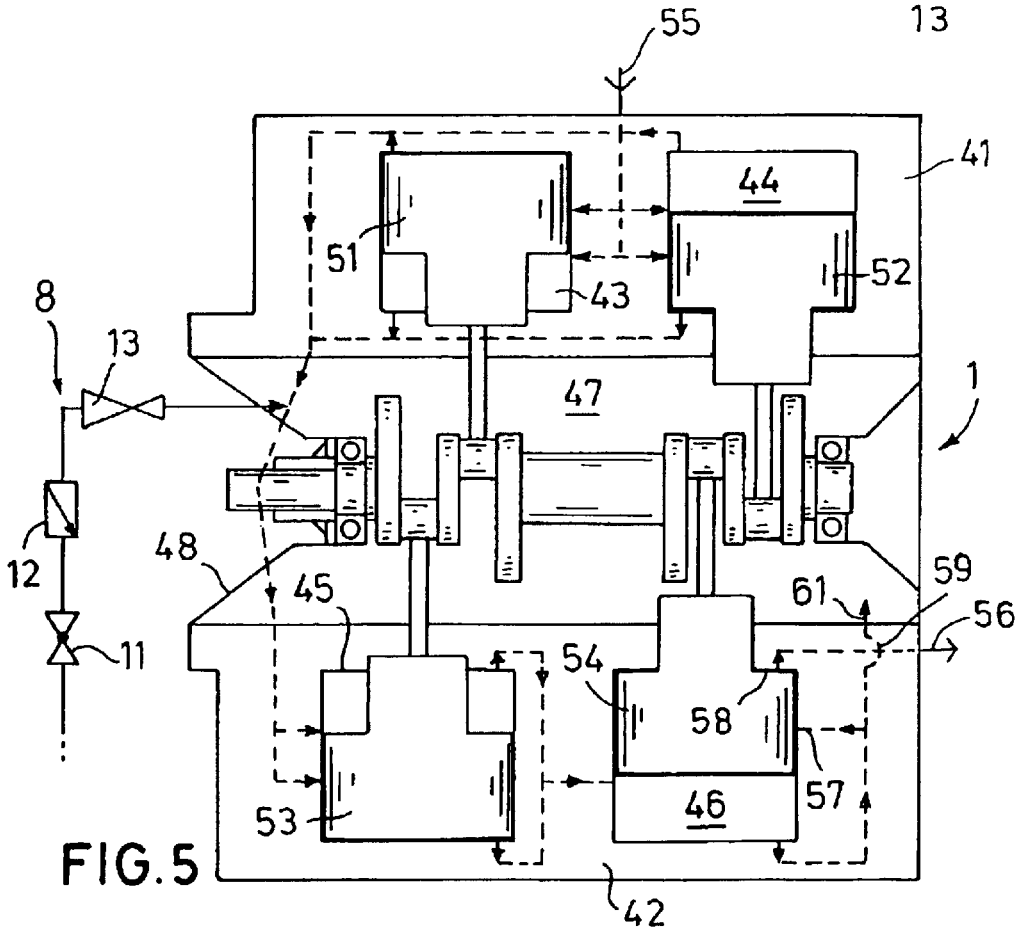

Depicted in FIGS. 4 and 5 is an embodiment (only partly in FIG. 4) of a dry compressing vacuum pump which is designed by way of a multi-stage piston vacuum pump. Located in its pump chamber casing sections 41 and 42 are the cylindrically shaped pump chambers 43 to 46. Located between casing section 41, 42 is the crankshaft chamber 47, the casing of which is designated as 48. The pistons 51 to 54 are each graduated and form eight pump chambers which are in part connected in parallel so that the depicted pump has four pumping stages decreasing in volume. Its inlet is designed as 55 and its outlet as 56. In the older German patent application 196 34 519.7 a vacuum pump of this kind is individually detailed. The last ring-shaped pump chamber forms the last stage of the vacuum pump depicted. Its inlet is designated as 57, its outlet as 58.

In the embodiment in accordance with FIG. 4, the gas ballast is supplied into the connecting line between the outlet of the last but one pumping stage and the inlet 57 of the last pumping stage. Gas ballast device 8 is connected to this connecting line.

In the embodiment with FIG. 5, the gas ballast is supplied through the crankshaft chamber 47 as is basically known from U.S. Pat. No. 6,123,516.

The inlet 57 of the last stage of the pump is linked via line 59 to the crankshaft chamber 47. The opening of said line forms the gas ballast inlet 61 in the vicinity of the pump chamber. Said opening is located in the vicinity of one of the face sides of crankshaft casing 48. In the area of the side opposing the crankshaft casing 48, there is located the gas ballast or purge gas inlet 8. With gas flowing in through the gas inlet 8, the crankshaft chamber 47 may be purged and/or an overpressure can be maintained within.

In the instance of piston vacuum pumps it is important that the pressure in the crankshaft casing 47 matches the pressure in the pump chambers. In particular starting a piston vacuum pump in the presence of a high pressure (atmospheric pressure, for example) in the crankshaft casing and a vacuum in the pump chambers 43 to 46 is difficult when employing AC motors offering only a weak starting torque. This will be the case when the pump is shut down with the vacuum chamber evacuated while purging the crankshaft casing 47 via the opened gas ballast device 8. If, however, the gas ballast supply is only opened after a pressure difference has been exceeded, a low pressure can be maintained in the crankshaft casing also when shutting the pump down. If, for example, the pressure difference defined by the differential pressure valve is 600 mbar, then with the gas ballast device 8 open, the crankshaft casing 47 will only be vented up to a pressure of approximately 400 mbar (atmospheric pressure minus 600 mbar).

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A dry compressing vacuum pump comprising:

a continuous or graduated inner compression chamber;

pumping element movably disposed in the compression chamber;

a gas ballast device connected with the chamber and having connected in series:

(1) an isolating valve;

(2) a non-return valve preventing the escape of gases from the pump through the gas ballast device to the outside; and a differential pressure valve which attains its open position only when a difference between atmospheric pressure and a pressure present at the differential pressure valve on the pump side exceeds 500 mbar.

2. The pump according to claim 1, wherein the vacuum pump is a screw vacuum pump and comprising plural pumping elements which include inter-engaging screw elements.

3. The pump according to claim 2, wherein the differential pressure valve opens at a pressure difference of 800 to 1000 mbar.

4. The pump according to claim 1, wherein the vacuum pump is a multi-stage piston vacuum pump which has a plurality of compression chambers, each with a pumping element.

5. The pump according to claim 4, further including:

a joint crankshaft chamber, the ballast gas being supplied through the crankshaft chamber.

6. The pump according to claim 4, wherein the gas ballast device is connected to a line which links the outlet of a penultimate stage to an inlet of the last stage.

7. A multi-state vacuum pump comprising:

a plurality of compression chambers interconnected to define a plurality of pumping stages;

a pumping element movably mounted in each chamber;

a gas ballast device having:

an interconnected isolating valve and a non-return valve connected with one of the stages to prevent the escape of gases from the pump through the gas ballast device to the outside, and a differential pressure valve configured to open at a pressure difference of 500 to 1000 mbar to admit gas from the outside to pass through the gas ballast device into the one stage.

8. A compressing vacuum pump comprising:

a plurality of compression stages with progressively higher compression from a first stage to a last stage;

a gas ballast which selectively supplies a ballast gas to one of the stages after the first stage and before the last stage, the gas ballast including:

a one-way valve and a pressure differential valve which permit the ballast gas to enter the one-stage when pressure in the one stage is below a pressure of the ballast gas by a 500–1000 mbar pressure differential and which block gases from leaving the one stage.

* * * * *